United States Patent [19]

Souza

[11] Patent Number: 4,770,451

[45] Date of Patent: Sep. 13, 1988

[54] SECURITY LOCK FOR HINGED ENTRY DOORS AND THE LIKE

[76] Inventor: David W. Souza, 41903 Corte Santa Barbara, Fremont, Calif. 94539

[21] Appl. No.: 933,245

[22] Filed: Nov. 20, 1986

[51] Int. Cl.[4] ..... E05C 19/18

[52] U.S. Cl. ..... 292/289; 292/262; 292/288

[58] Field of Search ..... 292/340, 288, 264, 292, 292/289, 297, 298, 293, 294, 295, 296, 262

[56] References Cited

U.S. PATENT DOCUMENTS

| | | | |
|---|---|---|---|
| 339,883 | 4/1886 | Hawes | 292/264 |
| 3,731,965 | 5/1973 | Adkinson, Jr. | 292/292 |
| 3,914,965 | 10/1975 | Paxton | 292/288 |
| 4,169,619 | 10/1979 | McCracken | 292/297 X |

*Primary Examiner*—Richard E. Moore
*Attorney, Agent, or Firm*—Robert C. Hill

[57] ABSTRACT

Multiple embodiments of a security lock for hinged entry doors or the like are disclosed, each having a strike plate adapted for mounting on the door jamb with a lock element being selectively operable for locking the door and being opened inwardly. In one embodiment, the lock element is engaged with a slotted extension of the strike plate for locking the door and with an offset plate portion for storing the lock element in an unlocked position out of engagement with the door. In another embodiment, the lock element is connected to an offset portion of the plate by an elongated flexible element such as a chain. In yet another embodiment, the lock element is an elongated hook member which is rotatably attached to the plate and extends inwardly of the door in its closed position, the hook member being rotatable into either a locking position for engaging the door after it is opened a short distance from the jamb or an unlocked position. In a further embodiment, the lock element is supported in an unlocked position upon a portion of the plate by a magnet. In a still further embodiment, the lock element is attached to a key for the door. Various combinations of these embodiments are also contemplated.

2 Claims, 3 Drawing Sheets

SECURITY LOCK FOR HINGED ENTRY DOORS AND THE LIKE

FIELD OF THE INVENTION

The present inventIon reIates to security locks for hinged entry doors and the like.

BACKGROUND OF THE INVENTION

A wide variety of security locks or lock assemblies have been provided in the prior art for use with hinged entry doors. Such security locks are of course widely desired in order to assure privacy or security for the occupants.

Most entry doors of the type contemplated by the present invention are provided with latch assemblies which engage automatically upon closing of the door and are released or opened for example by means of doorknobs or levers. The security lock of the present invention can be used as a supplemental device in addition to such a conventional door latch unit to provide greater security for the occupants.

In a conventional type of hinged entry door, the door closes against a jamb having a conventional strike plate The door itself is commonly equipped with a spring-loaded, beveled latch or bolt which automatically engages an opening in the strike plate when the door is closed. The beveled latch or bolt is retracted by operating a doorknob or lever when it is desired to open the door.

Latch assemblies of the above type are susceptible to forced or unauthorized entry which provides the impetus for employing a security lock of the type provided by the present invention.

In the past, one of the most common security devices was a deadbolt assembly for preventing forced entry. Security chains have also been employed, particularly when it is desirable to allow the door to open only a short distance. Such security chains are of course well known for allowing an occupant to see who is at the door before opening the door entirely.

Even with the variety of prior art security locks already available, there has been found to remain a need for improved designs either to overcome certain shortcomings in prior art designs or to provide greater versatility. For example, both the deadlock arrangements and security chains referred to above require the installation of hardware in both the hinged door and the door jamb itself.

In any event, there has been found to remain a need for further improvements in security locks for such hinged entry doors.

SUMMARY OF THE INVENTION

It is therefore an object of the invention to provide such an improved security lock for hinged entry doors or the like.

It is yet a further object of the invention to provide such a security lock which includes strike plate adapted for engagement with the jamb adjacent an edge of the door while being provided with an extension projecting inwardly of the door in its closed position, a lock element for positively preventing the door from being opened and attachment means formed on the plate extension for engaging the lock element and securing it in overlapping and locking engagement with the door.

Numerous variations are contemplated for the security lock described above. For example, the latching means and attachment means on the strike plate can be symmetrical to permit use of the security lock with either left hand or right hand doors.

It is a further related object of the invention to provide means for mounting the lock element in a storage condition out of engagement with the door. Mounting means for this purpose may comprise either a storage slot in which the lock element may be arranged out of engagement with the door, a chain for securing the lock element to an ofiset portion oi the plate or a magnet for similarly mounting the lock element in a storage position relative to the plate.

In a further variation, the lock element is attached to a key for the door, particularly for use in commercial establishments such as motels or the like. In this embodiment, identifying indicia or the like for the key can be placed on the lock element. Furthermore, when an occupant is inside the entry door, the lock element can be used both to provide a security lock for the door and to store the key in a manner convenient to the occupant.

It is a still further object of the invention to provide a security lock for hinged entry doors or the like comprising a plate which can be mounted on the jamb in parallel and adjacent relation with an edge of the door when it is closed against the jamb, an integral extension of the plate projecting inwardly of the door and comprising an engagement slot or other means for selectively engaging a lock element in overlapping locked engagement with the closed door.

It is yet another object of the invention to provide a security lock for hinged entry doors or the like including plate means adapted for mounting on the door jamb adjacent an edge of the door when it is closed and an elongated hook member which is rotatably attached to the plate means and extends inwardly of the closed door, the hook member being rotatable into a locking position for engaging the door after it is opened a short distance from the jamb and into an unlocked position where it remains out of engagement with the door.

It is a related object of the invention to provide a security lock of the type described immediately above in combination with a lock element of the type described further above for selectively preventing the door from being opened at all. Other combinations of means provided by the present invention can similarly be employed to advantage.

Additional objects and advantages of the invention are made apparent in the following description having reference to the accompanying drawings.

DESCRIPTION OF THE PREFERRED EMBODIMENTS

Figure 1:
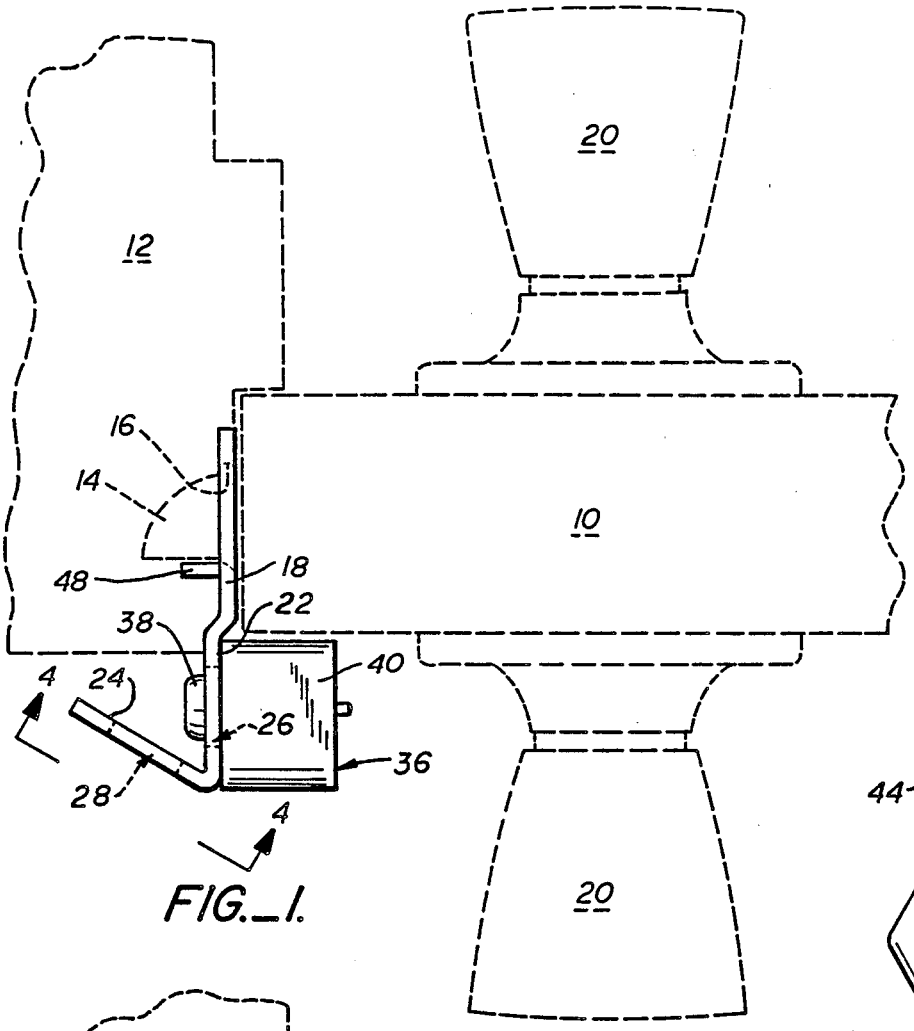
FIG. 1 illustrates one embodiment of a security lock constructed according to the present invention, the security lock being mounted upon a door jamb for a hinged entry door, fragmentary portions of both the hinged door and door jamb being illustrated in phantom.

Referring now to the drawings, the different embodiments of security locks disclosed below and illustrated in the drawings are contemplated for use with a conventional hinged entry door or the like as illustrated for example in FIGS. 1 and 12. Referring particularly to FIG. 1, the entry door is generally indicated at 10 in hinged relation to a door jamb 12. The entry door 10 is illustrated in a closed position where it is in engagement with the door jamb 12.

Figure 3:
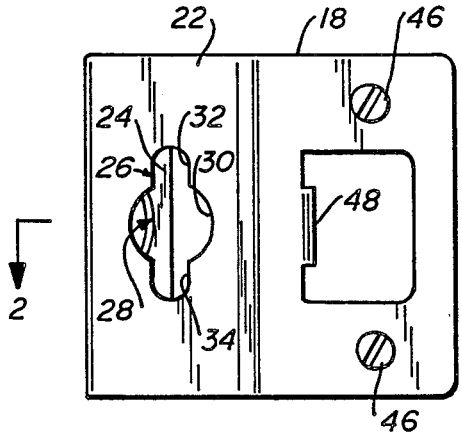
FIG. 3 is view taken along section line 3—3 of FIG. 2.

The entry door 10 is conventionally provided with beveled latch means 14 which automatically engage an opening such as that best illustrated at 16 in the strike plate 18 of FIG. 3. The latch means 14 is conventionally released from engagement with the strike plate for example by means of either doorknob 20 of FIG. 1.

All of the security lock embodiments of the present invention are contemplated for use with a similar type of hinged entry door and associated door jamb. Although the entry door and door jamb are illustrated only in FIGS. 1 and 12, operation of the other security lock embodiments can be clearly understood with reference to those FIGURES.

In tbe embodiment of FIGS. 1–4, it is again noted that the strike plate 18 is of generally conventional construction at least in the formation of the opening 16 for engagement with the door latch means 14. However, the strike plate 18 of the invention is formed with an integral extension 22. Referring particularly to FIG. 1, the extension 22 projects inwardly of the entry door 10 when it is closed against the door jamb 12. The strike plate 18 is also formed with an offset portion 24 arranged at an angle relative to the extension 22.

Both the integral extension 22 and the offset portion 24 are formed with symmetrical slots 26 and 28. Each of the slots 26 and 28 is formed with an enlarged central opening 30 and smaller slot portions 32 and 34 extending upwardly and downwardly from the central opening 30.

Figure 2:
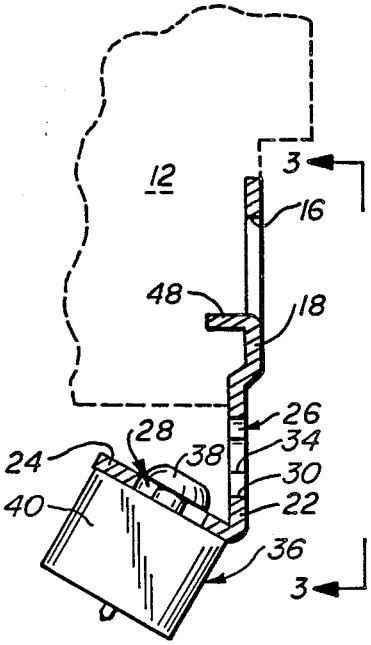
FIG. 2 a fragmentary view similar to FIG. 1 to illustrate another operating condition for the security lock.

A lock element 36 is illustrated in engagement with the symmetrical slot 26 in FIG. 1 and with the slot 28 in FIG. 2. The lock element 36 is of generally similar construction as that illustrated at 36′ in FIG. 5. The lock element 36 is similar to the lock element 36′ of FIG. 4 in that they each include a projecting portion 38 suitable for entering the enlarged central opening 30 of either symmetrical slot 26 or 28. Thereafter, the projecting portion 38 can be slid into one of the slot portions 32 and 34 (depending on arrangement of the plate 18) to maintain engagement of the lock element.

With the lock element in the symmetrical slot 26 on the extension plate 22, as illustrated in FIG. 1, the door 10 is positively prevented from opening. The lock element 36 is preferably formed with a resilient portion 40, positioned adjacent the entry door 10 to prevent the door from being damaged by engagement with the lock element. Obviously, the entire exposed body of the lock element 36 can be formed from such resilient material.

Alternatively, the lock element 36 is positioned in the symmetrical slot 28 on the offset plate portion 24 as illustrated in FIG. 2 where the lock element is stored in an unlocked position out of engagement with the door.

Before leaving the embodiment of FIGS. 1–4, it is noted that the opening 16 and the slots 26 and 28 are of symmetrical configuration so that the security lock of the present invention can be employed with either left hand or right hand doors.

Figure 5:
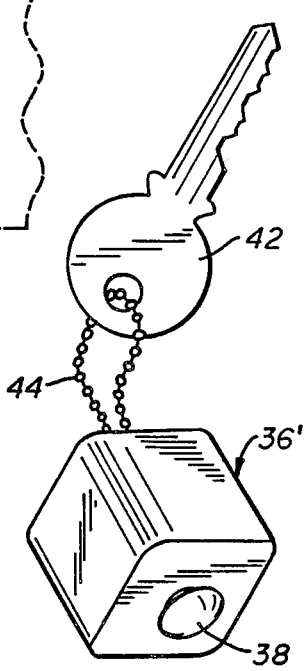
FIG. 5 is a pictorial representation of a lock element adapted for engagement with either the extension or offset portion of the strike plate in FIGS. 1 and 2 while being attached a key for unlocking the door of FIG. 1.
Figure 4:
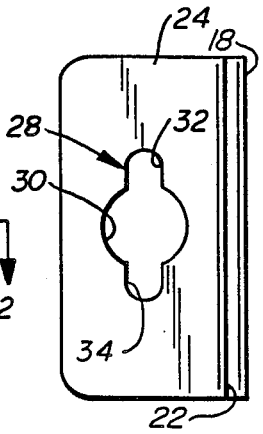
FIG. 4 is a view taken along section line 4—4 of FIG. 1
Figure 6:
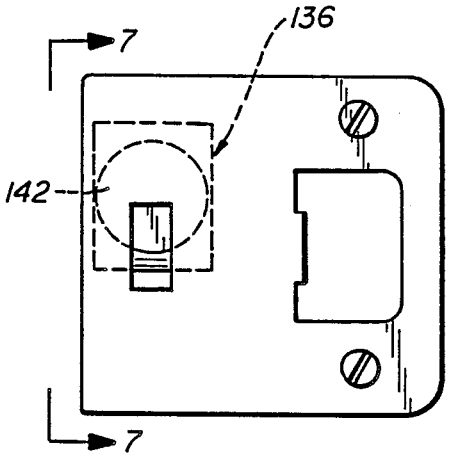
FIG. 6 a plan view of a plate for another embodiment.

Turning now to FIG. 5, the other embodiment 36′ of the lock element differs from the lock element 36 of FIG. 1 in that it is attached to a key 42 for the entry door 10 by means of a flexible chain 44. The lock element embodiment 36′ of FIG. 4 is particularly contemplated for use in commercial establishments such as motels as noted above. With the key 42 being attached to the lock element 36′, an occupant entering a motel room or the like can use the lock element 36′ to positively secure the entry door and at the same time provide convenient storage for the key 42. If desired, the lock element 36′ may be moved to a storage position in the same manner illustrated in FIG. 2 to allow opening of the door while still providing storage for the key 42.

Yet another embodiment of a lock element is illustrated at 136 in FIGS. 6–9. The lock element 136 is again of similar construction as the lock elements 36 and 36′. However, instead of the rounded projecting portion 38 illustrated in FIG. 5, the lock element 136 of FIGS. 6–9 is formed with a rectangular projecting portion 138.

Figure 7:
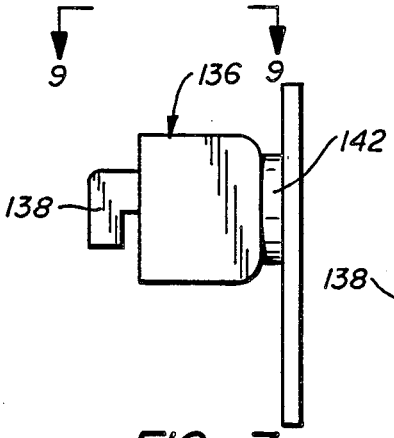
FIG. 7 is a view taken along section line 7—7 of FIG. 6 while illustrating a lock element in an unlocked or storage position.
Figure 8:
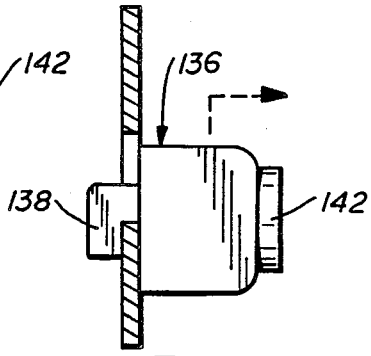
FIG. 8 is a view similar to FIG. 7 but with the plate shown in section and the lock element in a locking position.

Referring to FIG. 7, a slot 140 is illustrated in a plate extension 122 generally corresponding to the plate extension 22 illustrated in FIG. 3. The slot 140 of FIG. 7 is particularly adapted for engagement with the rectangular projection 138 on the lock element 136. The lock element is also provided with a magnet 142 for positioning it in a storage position on the back of the plate extension 122 out of engagement with the door (see FIG. 1 in comparison).

Figure 9:
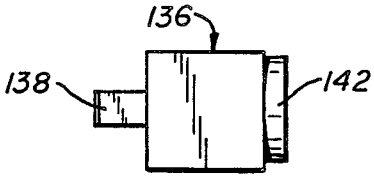
FIG. 9 is a view of the lock element taken along section line 9—9 FIG. 7.
Figure 10:
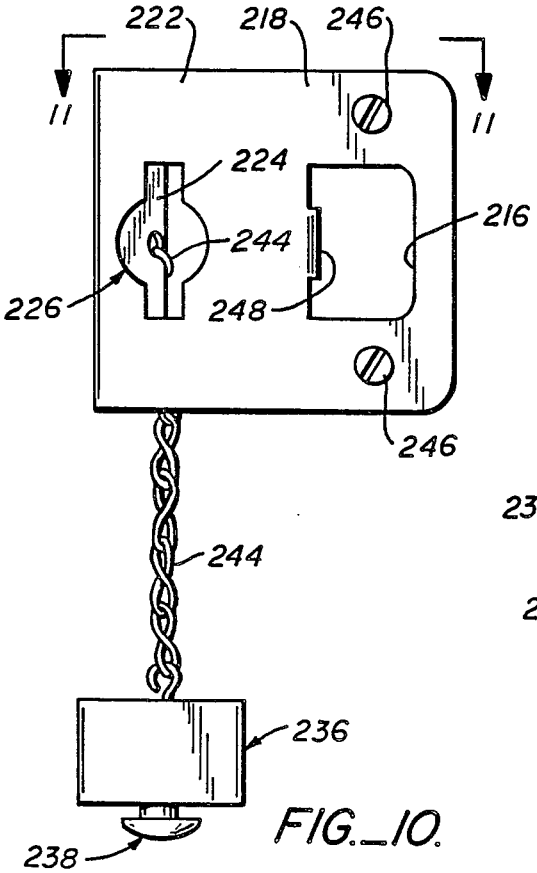
FIG. 10 is a view similar to FIG. 3 of another embodiment of a security lock constructed according to the present invention.

Referring now to FIGS. 9 and 10, another embodiment of a security lock is disclosed including a strike plate 218 of generally similar construction as the strike plate 18 of FIG. 3. The security lock of FIGS. 9 and 10 differs primarily from that of FIGS. 1–4 in that the offset plate portion 224 is not provided with a storage slot as illustrated at 28 in FIG. 3. In the embodiment of FIGS. 9 and 10, the storage slot 28 of FIGURE 3 is replaced by a chain 244 which secures the lock element to the offset plate portion 224.

Thus, the emhodiment of FIGS. 9 and 10 assures that the lock element 236 remains available for use with the slot 226 in the strike plate extension 222. When the lock element 236 is not employed for positively locking an entry door, it is suspended irom the offset plate portion 224 by means of the chain 244.

As with the strIke plate 18 of FIG. 1 the strike plate 218 is formed with holes (not shown) through which screws 246 pass for securing the strike plate 218 against a door jamb. Similarly, the opening 216 is formed with a tang 248 for engaging the door jamb and maintaining the strike plate in position thereupon.

Yet another embodiment of a security lock constructed according to the present invention is illustrated in FIGS. 12–15. This embodiment again includes a strike plate 318 generally similar to the strike plate 18 of FIGS. 1–4. The strike plate 318 has an integral extension plate 322 with a symmetrical slot 326 corresponding to similarly numbered portions of the security lock of FIGS. 1–4.

However, in place of the offset storage plate 24 of FIGS. 1–4, the strike plate 318 of FIGS. 12–15 is provided with an offset portion 328 providing a mounting for an elongated hook element 330. The elongated hook element 330 includes a mounting flange 332 which is secured to the offset portion 328 of the strike plate for example by means of a bolt and nut respectively indicated at 334 and 336.

Figure 11:
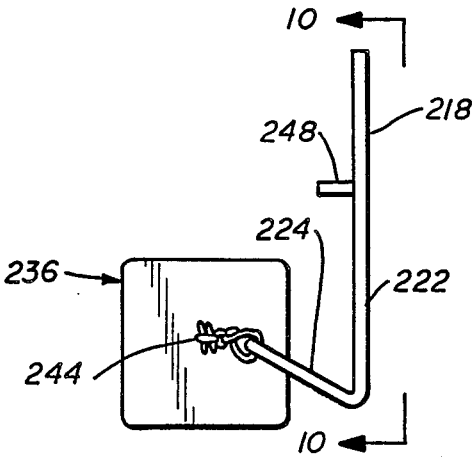
FIG. 11 is a view taken along section line 11—11 of FIG. 10.
Figure 14:
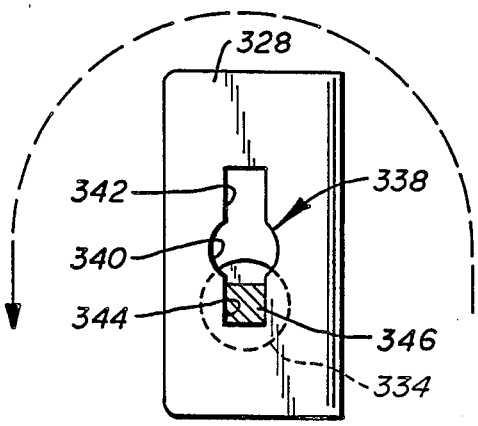
FIGS. 14 and 15 are views taken along section line 14—14 of FIG. 12 and section line 15—15 of FIG. 13 respectively.
Figure 15:
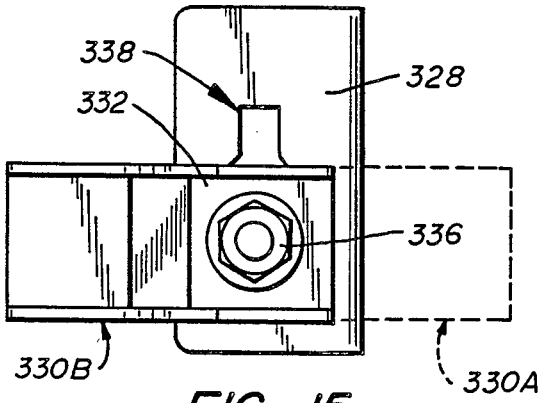

Referring particularly to FIGS. 14 and 15, a slot 338 in the offset portion 328 is formed with an enlarged central portion 340 and smaller upper and lower slot portions 342 and 344. The bolt 334 is provided with a rectangular shank as may be best seen at 346 in FIG. 14. The nut 336 is secured against rotation on the elongated hook element 330. Accordingly, in operation, the hook element 330 can be raised slightly so that the shank 346 of the bolt is in the enlarged central opening 340. In that position, the hock element 330 can be moved either to the locking position indicated at 330A in FIG. 12 or the unlocked position 330B as illustrated in FIG. 11. With the hook element in the desired position, it can then be moved into one of the slot portions 342 or 344 (depending on arrangement of the plate 318) to maintain the hook element in that position. Here again, the symmetrical configuration of the slot 338 permits use of the security lock assembly of FIGS. 10–12 on either left hand or right hand doors.

The length of the hook element 330 is selected so that an entry door, as indicated at 10 in FIG. 1, could be opened a short distance from the jamb, for example, to allow an occupant to see who is at the door before opening the door completely. Preferably, the elongated hook element 330 is also provided with a resilient pad 348 for engagement with the door.

Figure 12:
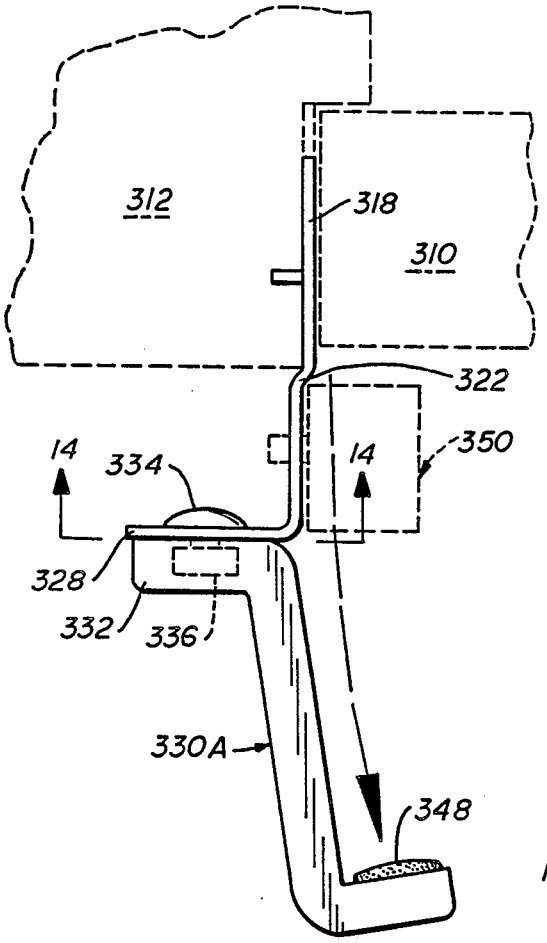
FIG. 12 is a view similar to FIG. 1 while illustrating yet another embodiment of a security lock constructed according to the present invention.
Figure 13:
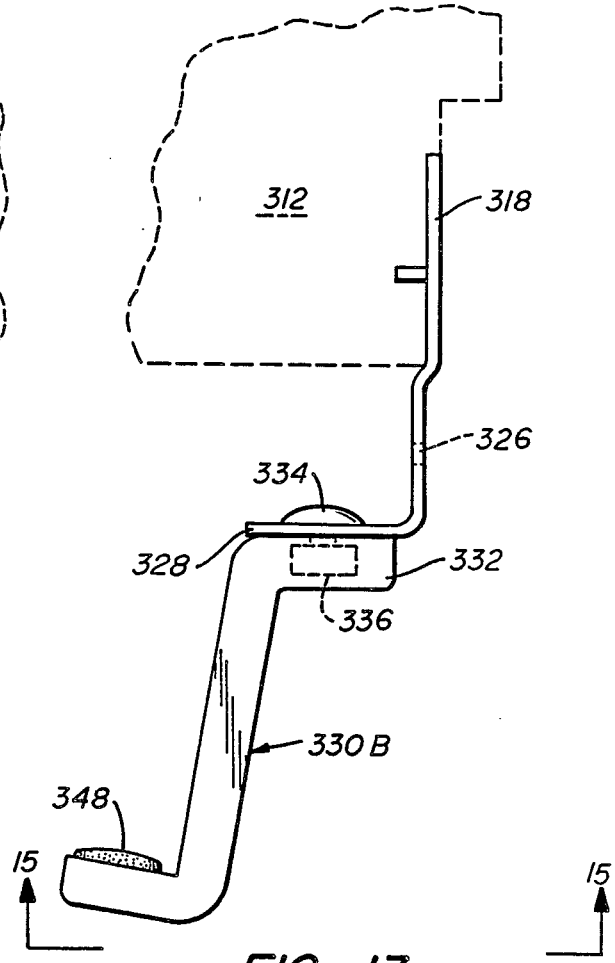
FIG. 13 is a view similar to FIG. 12 but with the security lock shown in a different operating position or condition.

The elongated hook element 330 can be employed by itself or in combination with a lock element illustrated in phantom at 350 in FIG. 12 and generally similar either to the lock element 36 of FIG. 1 or the lock element 36' of FIG. 4. In any event, the lock element 350 can be engaged with the symmetrical slot 326 in the integral extension plate 322 to provide a positive lock for the door in its closed position in the same manner described above in FIGS. 1–3.

Accordingly, there have been disclosed a number of embodiments for security locks according to the present invention, numerous modifications, variations and combinations of features from different embodiments can be employed in addition to those specifically described above. Accordingly, the scope of the present invention is defined only by the following appended claims.

What is claimed is:

1. A security lock for hinged entry doors or the like which engage a jamb when closed, comprising plate means adapted for mounting on the jamb adjacent an edge of the door when it is closed against the jamb and including an extension projecting inwardly of the door in its closed position, an elongated hook member attached to the plate means and extending inwardly of the door in its closed position, the hook member capable of being positioned into a locking position for engaging the door after it is opened a short distance from the jamb and into an unlocked position where it remains out of engagement with the door, a lock element for selectively locking the door and preventing it from opening inwardly, and attachment means formed on the plate means extension for engaging the lock element and securing it in overlapping and locking engagement with the door, the attachment means also permitting disengagement of the lock element to allow opening of the door.

2. The security lock of claim 1 wherein the plate means is a strike plate comprising means for latching the door in a closed position.

* * * * *